US006516873B1

(12) United States Patent
Haugen

(10) Patent No.: US 6,516,873 B1
(45) Date of Patent: Feb. 11, 2003

(54) HEAT EXCHANGER

(75) Inventor: Ronald L. Haugen, Mayfield, KY (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/645,312

(22) Filed: Aug. 25, 2000

(51) Int. Cl.[7] ..... F28F 9/26; F28D 1/00; F28D 7/02; F28D 9/00; F25B 1/10

(52) U.S. Cl. ..... 165/145; 165/164; 165/150; 62/401; 62/510

(58) Field of Search ..... 165/143, 144, 165/145, 164, 121, 150; 62/401, 402, 403, 510

(56) References Cited

U.S. PATENT DOCUMENTS

| | | | | | |
|---|---|---|---|---|---|
| 1,401,717 | A | * | 12/1921 | Halleck | 165/145 |
| 1,841,528 | A | * | 1/1932 | Gebhardt | 165/143 |
| 2,804,283 | A | * | 8/1957 | Ruszkowski | 165/143 |
| 2,856,677 | A | * | 11/1958 | Stone | 62/171 |
| 3,001,692 | A | * | 9/1961 | Schierl | 415/66 |
| 3,309,072 | A | * | 3/1967 | Cummings | 165/162 |
| 3,376,917 | A | * | 4/1968 | Fristoe et al. | 165/285 |
| 3,835,918 | A | * | 9/1974 | Pilarczyk | 165/47 |
| 3,907,032 | A | * | 9/1975 | DeGroote et al. | 165/143 |
| 4,208,529 | A | * | 6/1980 | Murray | 165/143 |
| 4,685,509 | A | * | 8/1987 | Koeller | 165/47 |
| 4,899,814 | A | * | 2/1990 | Price | 165/163 |
| 5,394,709 | A | * | 3/1995 | Lorentzen | 62/402 |
| 5,447,195 | A | * | 9/1995 | Luyts | 165/145 |
| 5,771,963 | A | * | 6/1998 | Blangetti et al. | 165/143 |
| 5,996,356 | A | * | 12/1999 | Kishimoto et al. | 62/510 |
| 6,341,650 | B2 | * | 1/2002 | Carpentier | 165/176 |

* cited by examiner

*Primary Examiner*—Henry Bennett
*Assistant Examiner*—Tho V Duong
(74) *Attorney, Agent, or Firm*—Michael Best & Friedrich, LLP

(57) ABSTRACT

A heat exchanger for a multi-stage air compressor. The heat exchanger includes several cooling chambers. Each cooling chamber is configured to receive compressed air from one of the compressor stages. A cooling tube is positioned to carry cooling fluid through each of the cooling chamber sequentially. The cooling chambers are also positioned in series so that heated fluid leaving the outlet of a first cooling chamber enters the inlet of a second cooling chamber after passing through an additional compressor stage.

18 Claims, 6 Drawing Sheets

HEAT EXCHANGER

BACKGROUND

The present invention relates to heat exchangers. More particularly, the invention relates to heat exchangers for cooling compressed air produced by multi-stage air compressors.

Typical gas compressors include a heat exchanger for reducing the temperature of the compressed gas. The heat exchanger or cooler reduces the temperature of the compressed gas or air to a predetermined temperature to make the compressed air easier to use. Shell and tube type heat exchangers are commonly employed in air compressors. Typically, the shell side of the heat exchanger carries the cooling fluid, normally water. In these conventional coolers the tubes typically contain the compressed air. The water flows through the cooler shell over the cooling tubes and the connected heat transfer fins as the air passes through the tubes. This conventional arrangement facilitates the transfer of heat from the compressed air to the water.

These conventional shell and tube type heat exchangers have several disadvantages. For example, the heat exchangers are difficult to maintain. The flow of water over the tubes generally results in the production of fouling and corrosion products on the shell side of the heat exchanger. The complicated geometry associated with the heat transfer fins and other components extending through the shell side make the fouling difficult to remove. Furthermore, existing heat exchanger designs can not accommodate multi-stage air compressors. Current heat exchanger designs require a separate heat exchanger or cooler for each compressor stage. Each heat exchanger requires its own water supply and must be maintained and serviced separately. Accordingly, there is a need for a single heat exchanger with improved serviceability that may be used to cool compressed air from multiple stages of a multi-stage air compressor.

The present invention addresses these needs.

SUMMARY OF THE INVENTION

According to one aspect of the present invention a heat exchanger comprising a plurality of cooling chambers configured to receive heated fluid is provided. Each cooling chamber includes a heated fluid inlet and a heated fluid outlet. The heat exchanger includes a cooling tube adapted to carry cooling fluid and positioned to pass through each of the plurality of cooling chambers. The cooling chambers may be operatively connected in series so that heated fluid leaving the outlet of a first cooling chamber enters the inlet of a second cooling chamber. In a preferred alternative, the cooling tube is positioned to carry cooling fluid sequentially through each of the cooling chambers.

The heat exchanger may further comprise a second cooling tube positioned to pass through each of the cooling chambers and adapted to carry cooling fluid sequentially through each of the cooling chambers so that the cooling fluid in the second cooling tube passes through the cooling chambers in the opposite direction to the cooling fluid in the first mentioned cooling tube. The first and second cooling tubes may be operatively connected in series.

Each cooling tube may include a plurality of heat transfer fins connected to the cooling tube and positioned to extend into each of the cooling chambers. Preferably, the cooling tube is cylindrically shaped and each of the fins extend radially outward from the tube. Preferably, the fins are configured in a herringbone or wavy configuration.

The heat exchanger may include a housing enclosing the cooling chambers and the cooling tube and a dividing wall positioned to separate the cooling chambers. The dividing wall may include an opening for receiving the cooling tube. The heat exchanger may further include a sealing mechanism positioned between the housing and an edge of the dividing wall to prevent mixing between the heated fluid contained in the cooling chambers. The housing may include a pair of manifolds positioned at opposite ends of the cooling chambers, wherein the first manifold is connected to a first end of the cooling tube and the second manifold is connected to a second end of the cooling tube.

According to another aspect of the present invention a multi-stage air compressor is provided. The air compressor includes a heat exchanger for cooling compressed air comprising a plurality of cooling chambers configured to receive compressed air; and a cooling tube configured to carry cooling fluid through each of the cooling chambers. The heat exchanger may be configured so that the compressed air exiting a first compressor stage passes through the first cooling chamber and into a second compressor stage; and the compressed air exiting the second compressor stage passes through the second cooling chamber.

The heat exchanger may include a second cooling tube configured to carry cooling fluid through each of the cooling chambers in a direction opposite to the first mentioned cooling tube, wherein the first and second cooling tubes are operatively connected in series so that cooling fluid exiting the first cooling tube enters the second cooling tube. The heat exchanger may also include a plurality of heat transfer fins connected to the cooling tubes and positioned to extend into each of the cooling chambers. The cooling tubes may be generally cylindrically shaped and each of the fins may extend radially outward from the tube.

The heat exchanger may include a housing enclosing the cooling chambers and the cooling tube. The housing may includes a pair of manifolds positioned at opposite ends of the cooling chambers, wherein the first manifold is connected to a first end of the cooling tube and the second manifold is connected to a second end of the cooling tube. The housing may include a dividing wall positioned to separate the cooling chambers. The dividing wall may include an opening for receiving the cooling tube. The heat exchanger may further comprises a sealing mechanism positioned between the housing and an edge of the wall to prevent mixing between the compressed air contained in the cooling chambers.

It is to be understood that both the foregoing general description and the following detailed description are exemplary and explanatory only, and are not restrictive of the invention as claimed.

BRIEF DESCRIPTION OF THE DRAWINGS

These and other features, as aspects, and advantages of the present invention will become apparent from the following description, appended claims, and the accompanying exemplary embodiment shown in the drawings, which are briefly described below.

DETAILED DESCRIPTION

Although references are made below to directions, such as left, right, up, down, etc., in describing the drawings, they are made relative to the drawings (as normally viewed) for convenience. These directions are not intended to be taken literally or limit the present invention in any form.

According to the present invention a heat exchanger is provided to cool a gas or fluid. Preferably, the heat exchanger 50 is employed with an air compressor system and is used to cool compressed air. However, the heat exchanger is suitable for use to cool any type of fluid.

Figure 9:
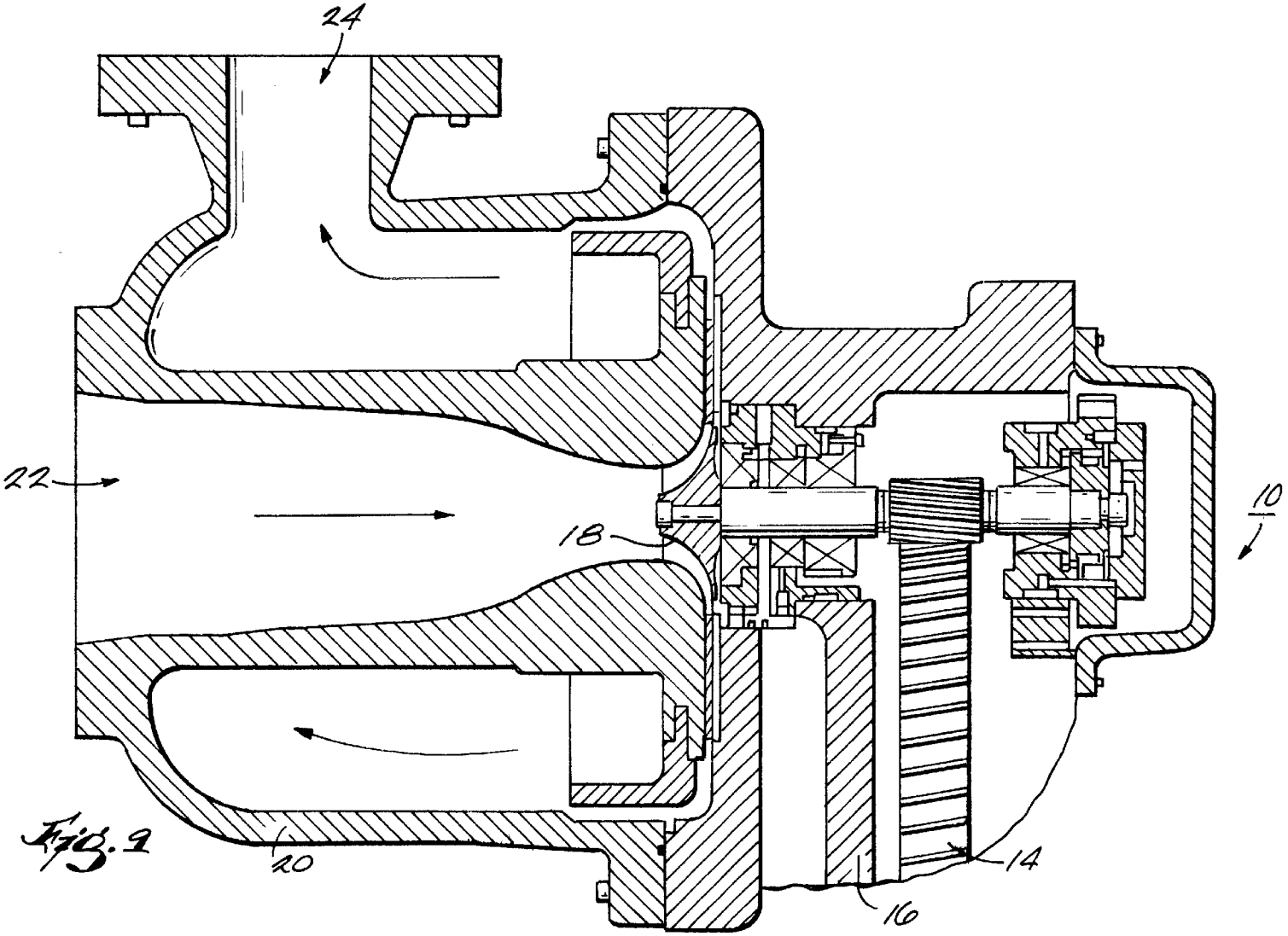
FIG. 9 is a cross-sectional view of a single stage of a centrifugal air compressor.

By way of example a centrifugal air compressor is shown in FIG. 9. The centrifugal compressor 10 compresses a low pressure fluid, such as air, to a predetermined pressure, and supplies the compressed air to a compressed air system for use in any number of well known applications. A prime mover is engageable with a gear drive system 14 which is mounted for operation in a suitably dimensioned housing 16. An impeller assembly 18 is engaged with the gear drive system which dives the impeller assembly during compressor operation. The compressor 10 may be part of a single stage or a multi-stage design.

Figure 1:
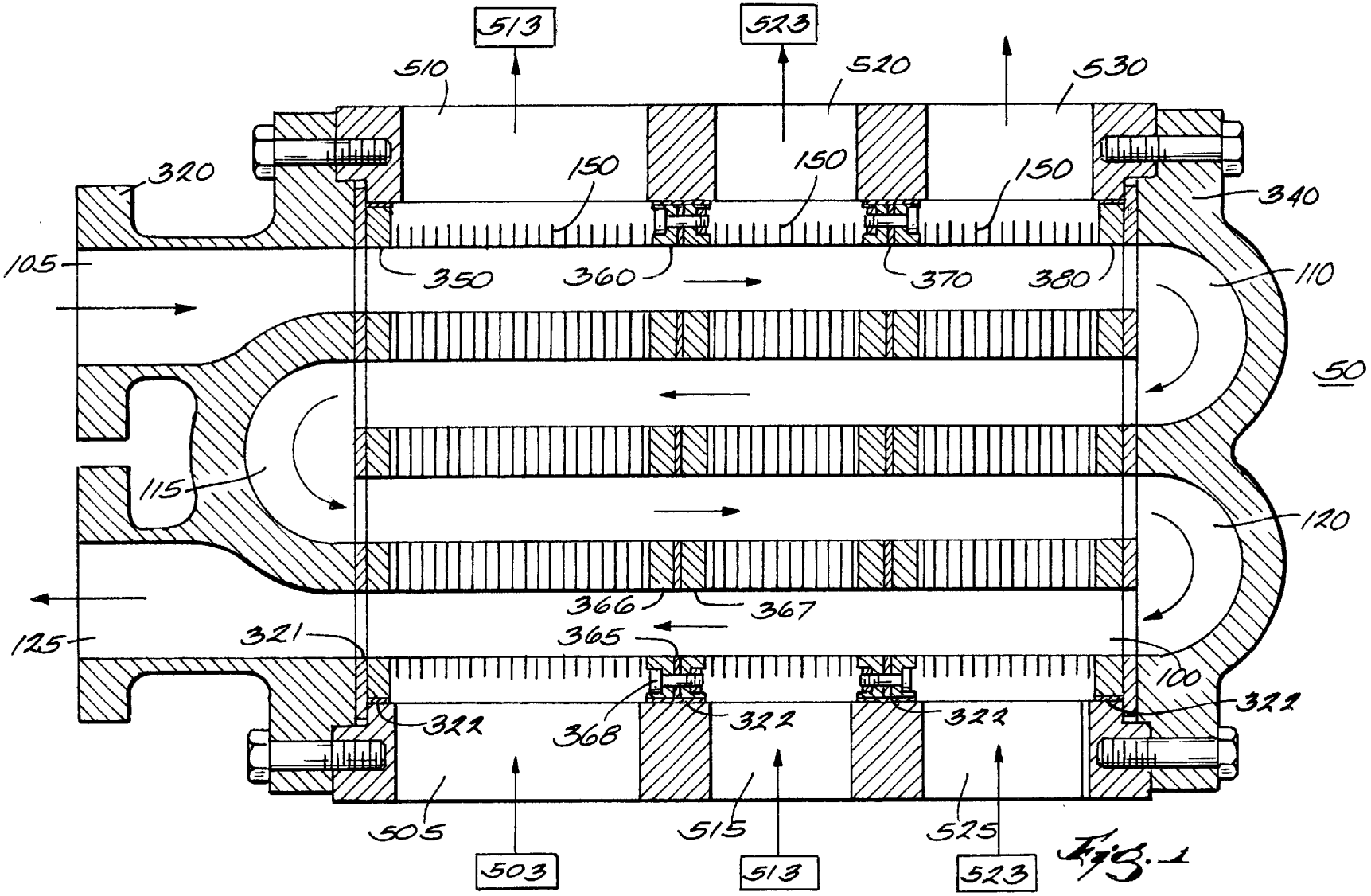
FIG. 1 is a cross-sectional view of a heat exchanger according to an embodiment of the invention.

A compressor housing section 20 houses the impeller assembly 18, and includes an inlet duct 22 and a discharge duct 24. For a multi-stage compressor, the discharge duct 24 may be connected with the inlet duct of a follow on stage. The compressed air leaving the compressor housing 20 through duct 24 is preferably directed to a cooler or heat exchanger 50, such as shown in FIG. 1, for example. Although FIG. 9 depicts a centrifugal compressor, it is within the scope of the invention to employ the heat exchanger described further below with any air compressor such as, for example, rotary screw or reciprocating.

The heat exchanger shown in FIG. 1 includes three stages. The stages are positioned adjacent one another so that the heated fluid to be cooled travels in the same direction through each stage as indicated by the vertical arrows shown in FIG. 1. The heat exchanger includes cooling tubes 100 which are aligned in a direction generally perpendicular to the direction of flow of the heated fluid through each of the heat exchanger stages. The cooling fluid may make several passes through the heat exchanger 50 before exiting the heat exchanger.

Figure 2:
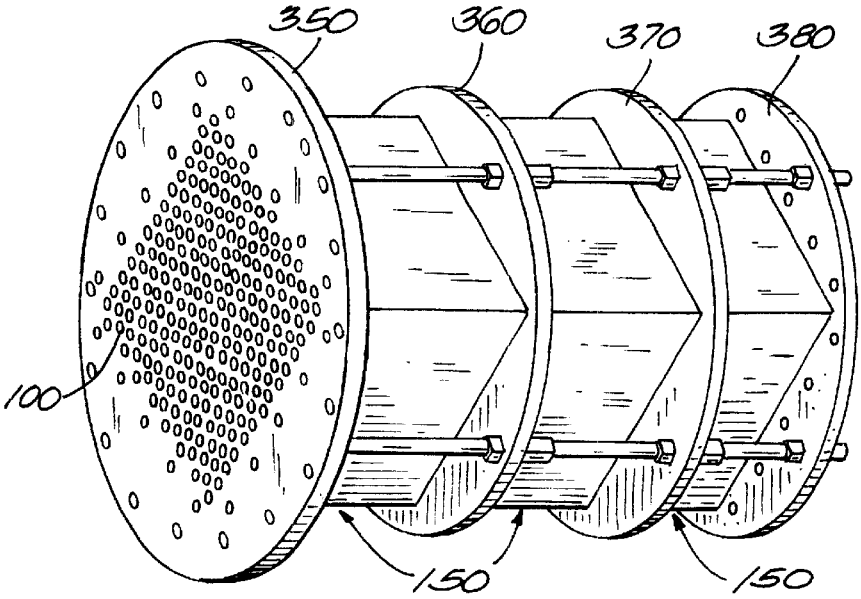
FIG. 2 is a perspective view of the internal components of a heat exchanger according to an embodiment of the invention, for simplicity details regarding the heat transfer fins have been omitted.
Figure 3:
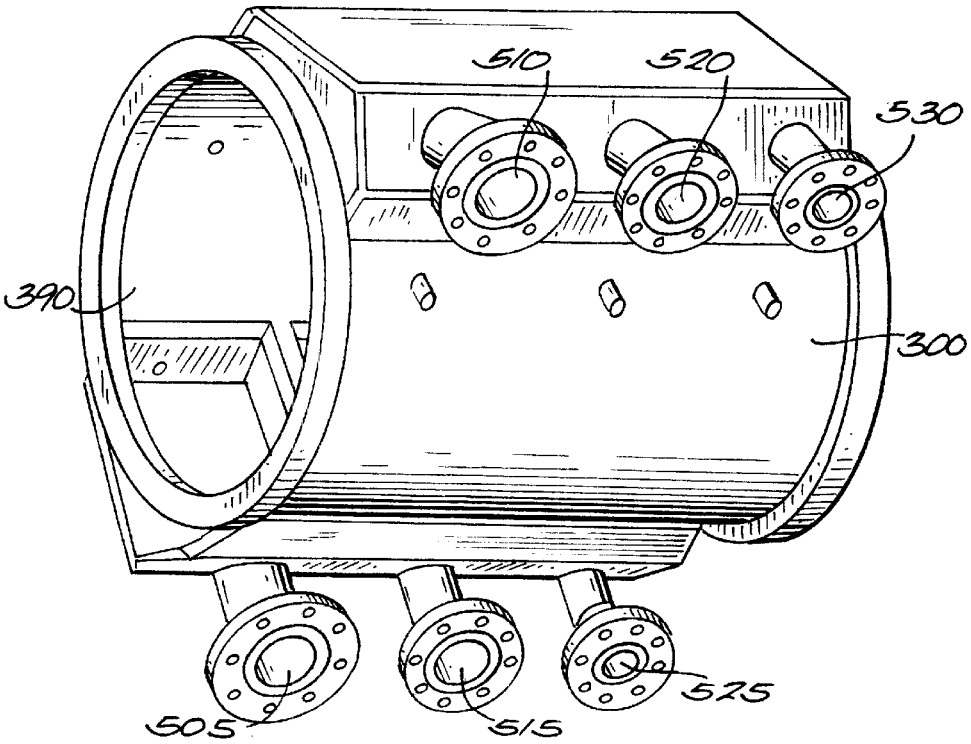
FIG. 3 is a perspective view of the housing for the heat exchanger of FIG. 2.

As shown in FIG. 3, the heat exchanger may include a housing 300 which contains the cooling tubes 100 and the open shell for each stage through which the heated fluid passes. The housing 300 includes a front manifold 320 and a rear manifold 340, as shown in FIGS. 5–8. Each of the heat exchanger stages is separated by a dividing wall as shown in FIGS. 1 and 2. The end wall or header plates 350, 380 are connected to the front and rear manifolds 320, 340. Interior dividing walls 360, 370 separate the various stages of the heat exchanger.

Cooling fluid is provided to the cooling tubes 100 through the inlet duct 105. The cooling fluid is carried by a tube 100 and passes through each heat exchanger stage sequentially until exiting through the rear header plate 380 into an upper cavity 110 in the rear manifold 340. The cooling fluid is redirected in the upper cavity 110 and passes back through the heat exchanger stages in the opposite direction through a cooling tube 100 until reaching the front manifold 320. The front manifold includes a central cavity 115 opening toward the cooling tubes 100. Cooling fluid exiting the cooling tubes is redirected in the central cavity 115 and is routed back through the heat exchanger stages toward the rear manifold 340. Upon exiting the last heat exchanger stage the cooling fluid enters a lower cavity 120 of the rear manifold 340. Similar to the upper cavity 110, the lower cavity 120 redirects the cooling fluid back through the heat exchanger stages in reverse order. As shown in FIG. 1, the cooling fluid exits the heat exchanger through a discharge duct 125 in the front manifold 320.

For simplicity, FIG. 1 only shows four passes of cooling fluid through the heat exchanger. However, as shown in FIGS. 2 through 8, the cooling fluid may pass through the heat exchanger additional times. Similarly, FIG. 1 always shows a single cooling tube 100 being utilized for each pass of cooling fluid through the heat exchanger. However, it is within the scope of the invention to employ a plurality of cooling tubes 100 as shown in FIG. 2, for example.

The area between the tubes and the compressor housing, commonly referred to as the shell side 390, receives a fluid to be cooled. The shell side will typically receive compressed air when the heat exchange is employed with an air compressor. As shown in FIG. 1, compressed air produced by the first stage of the air compressor is supplied to the first stage inlet duct 505. The compressed air passes through the heat exchanger and exits through the first stage discharge duct 510. After exiting the heat exchanger, the compressed fluid may be supplied to a second compressor stage. In the second stage, the compressed air is further compressed increasing the pressure and temperature of the fluid to be cooled. The heated fluid exiting the second stage of the air compressor is supplied to the second stage inlet duct 515 of the heat exchanger. The heated fluid exits the second stage of the heat exchanger through the second stage discharge duct 520, as shown in FIG. 1. The air may be further compressed in a third compressor stage. Air exiting the third compressor stage is supplied to the third stage inlet duct 525 of the heat exchanger. After passing through the heat exchanger the heated fluid exits through the third stage exit duct 530. The heating fluid having been cooled is now in condition for storage or immediate use by equipment requiring compressed air.

The heated fluid or air in each heat exchanger stage is separated from the adjacent heat exchanger stage by the dividing walls. The dividing walls also provide support for the cooling tubes 100 as shown in FIG. 2. The heat exchanger includes a sealing mechanism to prevent leakage between the heat exchanger stages. As shown in FIG. 1, the sealing mechanism may include a gasket 365 sandwiched between two supporting walls, 366, 367. A bolt or fastener 368 may be used to secure the sealing mechanism. The front and rear header plates may similarly include a gasket 321 positioned to be retained in place by the manifolds 320, 340. Each manifold may be secured to the housing 300 with the gasket 321 sandwiched therebetween. Alternatively the sealing mechanism may include an o-ring or gasket positioned along the outer edge of the header 350, 380 between the dividing wall and the housing.

As shown in FIG. 2, the size of each cooling chamber may be selected to provide the appropriate amount of heat transfer. By varying the number of tubes and the size of cooling chambers a wide range of heat transfer profiles may be produced.

Figure 4:
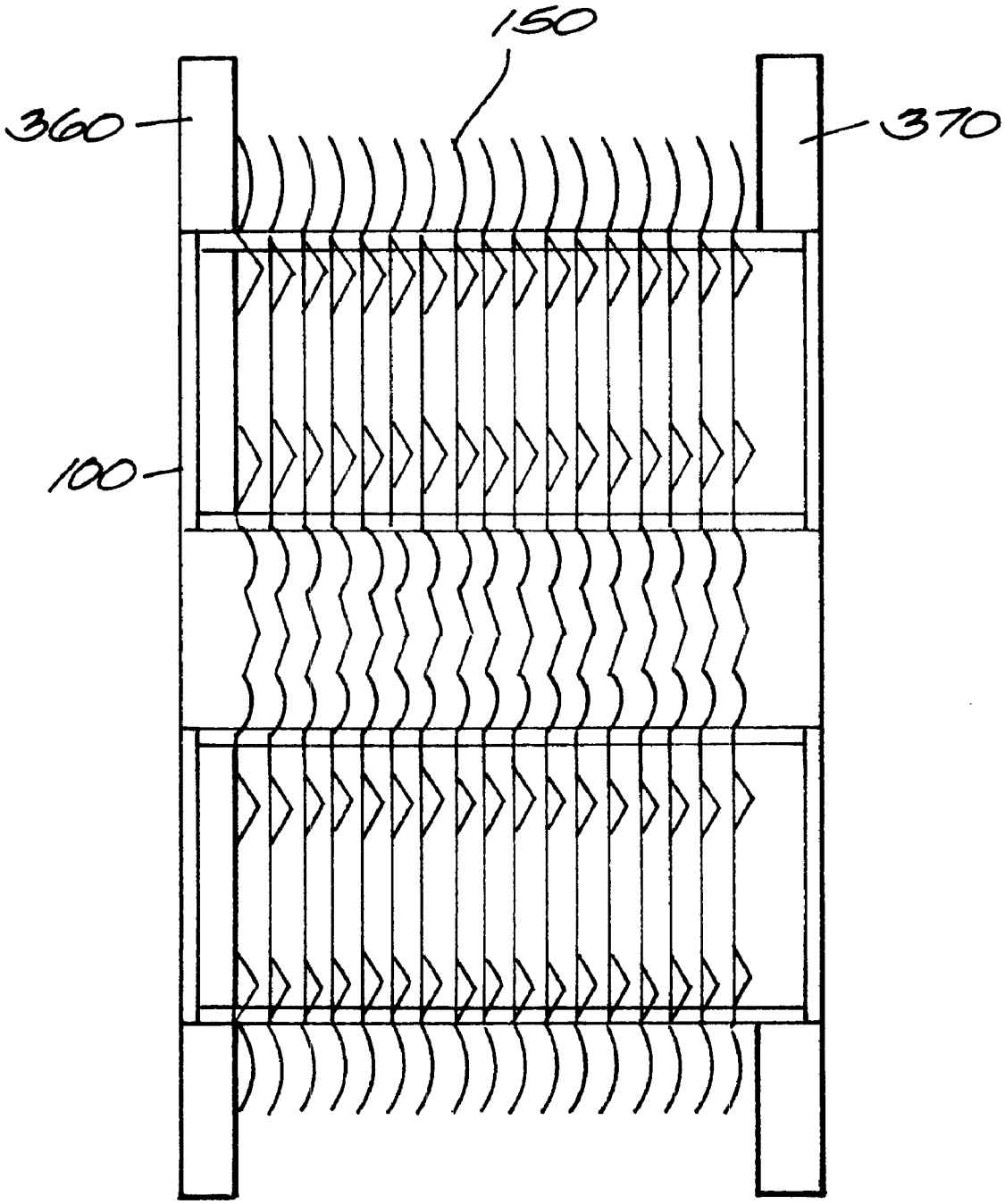
FIG. 4 is a partial side view of the middle stage of the heat exchanger shown in FIG. 3.
Figure 6:
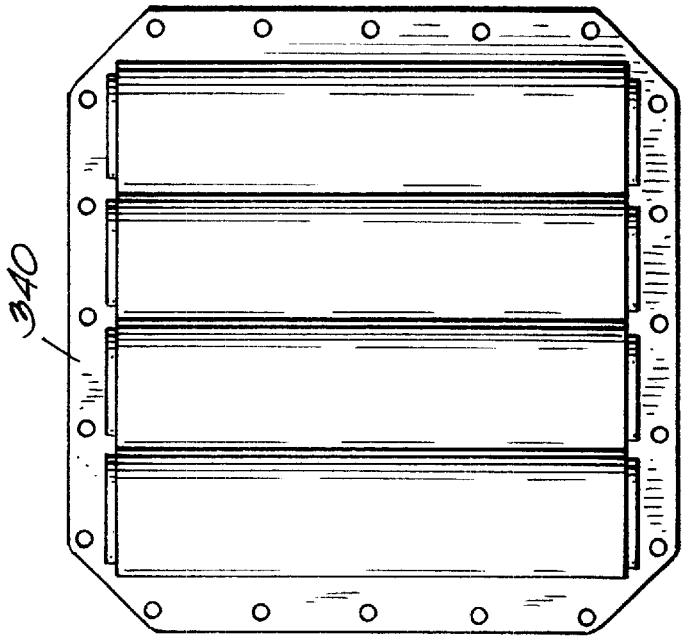
FIG. 6 is an end view in elevation of the rear end manifold of FIG. 5.
Figure 5:
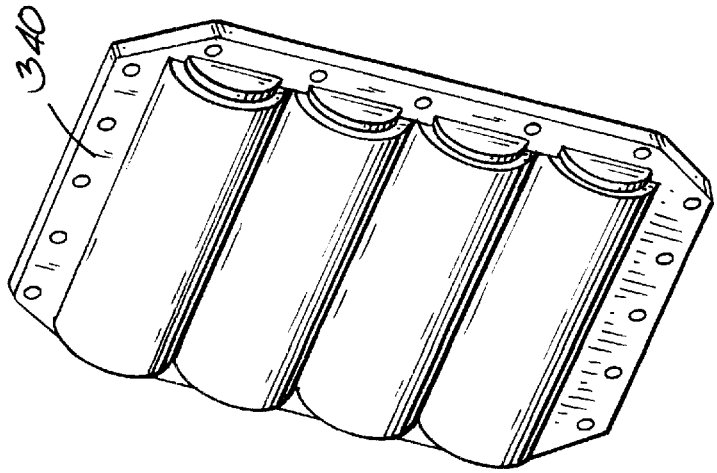
FIG. 5 is a perspective external view of the rear end manifold for the heat exchanger housing of FIG. 3.
Figure 8:
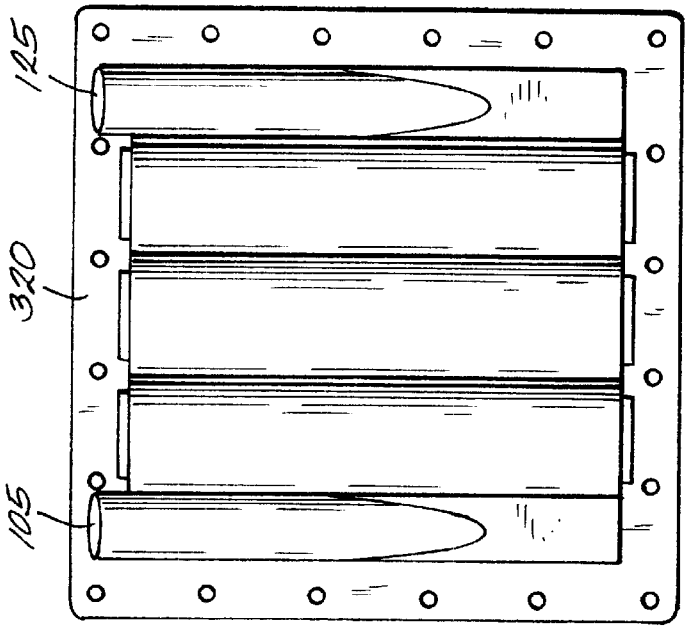
FIG. 8 is an end view in elevation of the front end manifold of FIG. 7.
Figure 7:
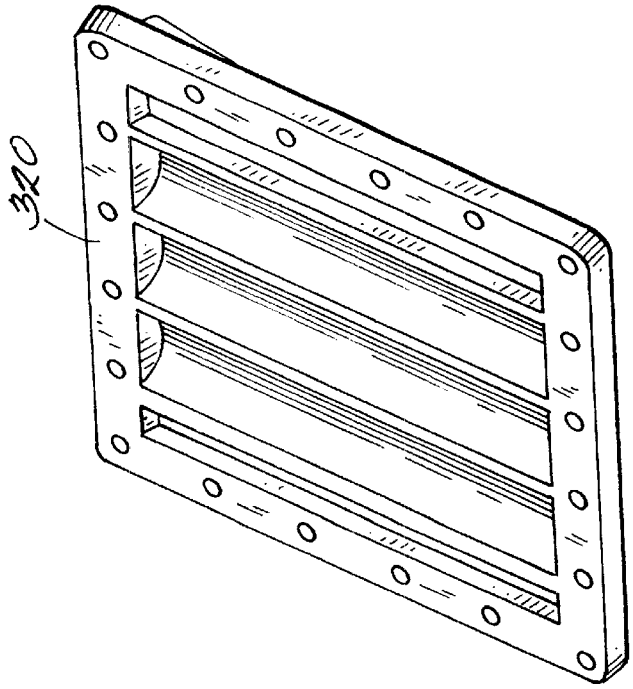
FIG. 7 is a perspective internal view of the front end manifold for the heat exchanger housing of FIG. 3.

In order to improve the heat transfer between the cooling fluid and the heated fluid, the cooling tubes 100 are preferably surrounded by heat transfer fins 150, as shown in FIGS. 1 and 2. For simplicity the details regarding the individual fins have been omitted from FIG. 2. FIG. 4 is a partial side view of the heat exchanger of FIG. 2 showing the fin detail. As shown in FIG. 4, the heat transfer fins preferably have a wavy configuration. Fins can have many different cross-section patterns such as plate, herringbone or raised lance. FIG. 4 shows a typical herringbone cross-section. The heat transfer fins 150 are preferably formed from aluminum but can be made using stainless steel. As a further alternative, the wavy fins may be replaced with fins that are slotted transversely to the direction of airflow. As an alternative to fins, spiral shaped cooling tubes may be employed to increase the heat transfer area of the tube.

The dividing walls or headers are preferably formed from stainless steel to improve corrosion resistance. Similarly the cooling tubes 100 may be formed from copper-nickel alloy in order to improve corrosion resistance. The water through the tube cooler described above offers the further advantage of permitting brush cleaning or mechanical rodding of the tubes to remove deposits.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A heat exchanger comprising:

a plurality of cooling chambers configured to receive heated fluid, each cooling chamber having a heated fluid inlet and a heated fluid outlet;

a first cooling tube positioned to pass through each of the plurality of cooling chambers and adapted to carry cooling fluid;

a second cooling tube positioned to pass through each of the cooling chambers and adapted to carry cooling fluid sequentially through each of the cooling chambers so that the cooling fluid in the second cooling tube passes through the cooling chambers in the opposite direction to the cooling fluid in the first cooling tube;

a housing enclosing the cooling chambers and the cooling tubes;

a dividing wall positioned to separate the cooling chambers, wherein the dividing wall includes an opening for receiving the cooling tubes; and wherein the heat exchanger is configured so that the fluid exiting a first cooling chamber passes through a compressor stage and into a second cooling chamber.

2. The heat exchanger of claim 1, further comprising a sealing member positioned between the housing and an edge of the dividing wall to prevent mixing between the heated fluid contained in the cooling chambers.

3. The heat exchanger of claim 1, wherein the cooling tubes are positioned to carry cooling fluid sequentially through each of cooling chambers.

4. The heat exchanger of claim 1, wherein the first and second cooling tubes are operatively connected in series.

5. The heat exchanger of claim 1, further comprising a plurality of heat transfer fins connected to the cooling tubes and positioned to extend into each of the cooling chambers.

6. The heat exchanger of claim 1, wherein the cooling tubes are generally cylindrically shaped and each of the fins extend radially outward from the cooling tubes.

7. The heat exchanger of claim 5, wherein at least one fin includes a wavy configuration.

8. The heat exchanger of claim 1, wherein the housing includes a first manifold and a second manifold positioned at opposite ends of the housing, wherein the first manifold is connected to a first end of the first cooling tube and the second manifold is connected to a second end of the first cooling tube.

9. The heat exchanger of claim 1, wherein the direction of flow of the cooling fluid through the first cooling tube is substantially transverse to the direction of flow of the heated fluid through the cooling chambers.

10. The heat exchanger of claim 1, comprising three cooling chambers.

11. A multi-stage air compressor comprising:

a heat exchanger for cooling compressed air comprising:

a plurality of cooling chambers configured to receive compressed air; and a first cooling tube configured to carry cooling fluid through each of the cooling chambers;

a second cooling tube configured to carry cooling fluid through each of the cooling chambers in a direction opposite to the first cooling tube; and wherein the heat exchanger is configured so that the compressed air exiting a first compressor stage passes through a first cooling chamber and into a second compressor stage, and the compressed air exiting the second compressor stage passes through a second cooling chamber;

a housing enclosing the cooling chambers and the cooling tubes; and a dividing wall positioned to separate the cooling chambers, wherein the dividing wall includes an opening for receiving the cooling tubes.

12. The air compressor of claim 11, further comprising a sealing member positioned between the housing and an edge of the dividing wall to prevent mixing between the compressed air contained in the cooling chambers.

13. The air compressor of claim 11, wherein the housing includes a first manifold and a second manifold positioned at opposite ends of the housing, wherein the first manifold is connected to a first end of the first cooling tube and the second manifold is connected to a second end of the first cooling tube.

14. The air compressor of claim 11, wherein the direction of flow of the cooling fluid through the first cooling tube is substantially transverse to the direction of flow of the heated fluid through the cooling chambers.

15. The air compressor of claim 11, comprising three cooling chambers.

16. The air compressor of claim 11, wherein the first and second cooling tubes are operatively connected in series so that cooling fluid exiting the first cooling tube enters the second cooling tube.

17. The air compressor of claim 11, further comprising a plurality of heat transfer fins connected to the cooling tubes and positioned to extend into each of the cooling chambers.

18. The air compressor of claim 17, wherein the cooling tubes are generally cylindrically shaped and each of the fins extend radially outward from the tube.

* * * * *

UNITED STATES PATENT AND TRADEMARK OFFICE

CERTIFICATE OF CORRECTION

PATENT NO. : 6,516,873 B1
DATED : February 11, 2003
INVENTOR(S) : Ronald L. Haugen It is certified that error appears in the above-identified patent and that said Letters Patent is hereby corrected as shown below:

Column 6,
Line 1, should read:
-- The heat exchanger of claim 5, … --

Signed and Sealed this

Fifteenth Day of July, 2003

JAMES E. ROGAN
*Director of the United States Patent and Trademark Office*